United States Patent [19]

Nishise et al.

[11] Patent Number: 4,984,026

[45] Date of Patent: Jan. 8, 1991

[54] COLOR IMAGE FORMING METHOD

[75] Inventors: Hideya Nishise; Akihiro Nishida, both of Osaka, Japan

[73] Assignee: Minolta Camera Kabushikia Kaisha, Osaka, Japan

[21] Appl. No.: 342,358

[22] Filed: Apr. 24, 1989

[30] Foreign Application Priority Data

Apr. 25, 1988 [JP] Japan ..... 63-103438
Apr. 25, 1988 [JP] Japan ..... 63-103439

[51] Int. Cl.[5] ..... G03G 15/14; G03G 15/01

[52] U.S. Cl. ..... 355/277; 355/271; 355/273; 355/274; 355/275; 430/126

[58] Field of Search ..... 355/271–277, 355/326–327, 281; 430/48, 126

[56] References Cited

U.S. PATENT DOCUMENTS

| | | | |
|---|---|---|---|
| 3,697,170 | 10/1972 | Bhagat et al. | 355/17 |
| 3,697,171 | 10/1972 | Sullivan | 355/17 |
| 3,729,311 | 4/1973 | Langdon | 355/274 X |
| 3,893,761 | 7/1975 | Buchan et al. | 355/272 |
| 3,904,406 | 9/1975 | Takahashi | 96/1.4 |
| 4,021,109 | 5/1977 | Tanaka et al. | 355/272 X |
| 4,521,502 | 6/1985 | Sakai et al. | 430/48 X |
| 4,542,978 | 9/1985 | Tarumi et al. | 355/3 TR |
| 4,652,115 | 3/1987 | Palm et al. | 355/327 |
| 4,664,500 | 5/1987 | Kohler et al. | 355/217 |
| 4,684,238 | 8/1987 | Till et al. | 355/275 |
| 4,690,539 | 9/1987 | Radulski et al. | 355/326 |
| 4,788,572 | 11/1988 | Slayton et al. | 355/326 X |

FOREIGN PATENT DOCUMENTS

| | | | |
|---|---|---|---|
| 2811076 | 9/1978 | Fed. Rep. of Germany | 355/275 |
| 56-147166 | 11/1981 | Japan . | |
| 0191662 | 11/1982 | Japan | 355/273 |
| 60-33575 | 2/1985 | Japan . | |
| 62-206567 | 9/1987 | Japan | 355/275 |
| 0223678 | 9/1988 | Japan | 355/275 |
| 88/05563 | 7/1988 | World Int. Prop. O. | 355/275 |

*Primary Examiner*—R. L. Moses
*Assistant Examiner*—Matthew S. Smith
*Attorney, Agent, or Firm*—Willian Brinks Olds Hofer Gilson & Lione

[57] ABSTRACT

A color image forming method using a toner image retaining member is disclosed. In the color image forming method, a plurality of electrostatic latent images corresponding to respective color components of an image of a document are formed sequentially on a photoconductive member, and the electrostatic latent images are developed sequentially with respective toners of different colors so as to form the corresponding visible toner images on the photoconductive member. Thereafter, the toner images are transferred sequentially onto the toner image retaining member by electrifying the toner image retaining member every transfer process for each of the toner image so as to form a color image thereon, and the color image is transferred onto a paper.

6 Claims, 10 Drawing Sheets

Fig. 2
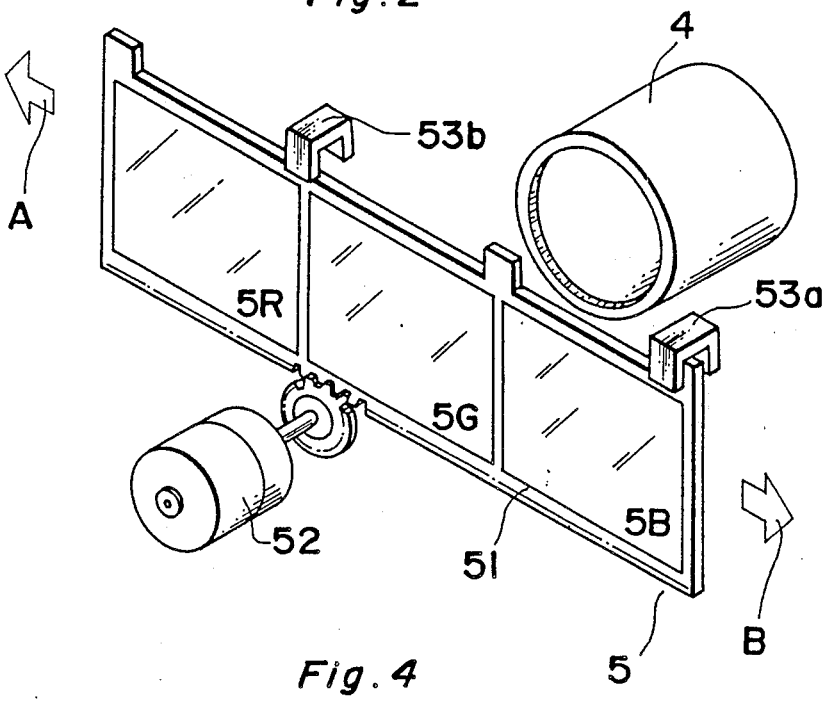
Fig. 4
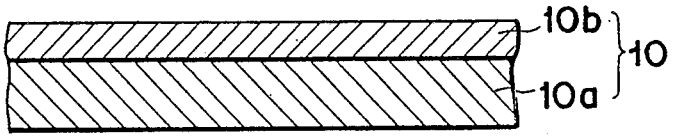
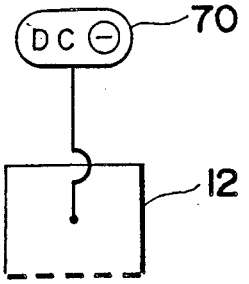
Fig. 5A
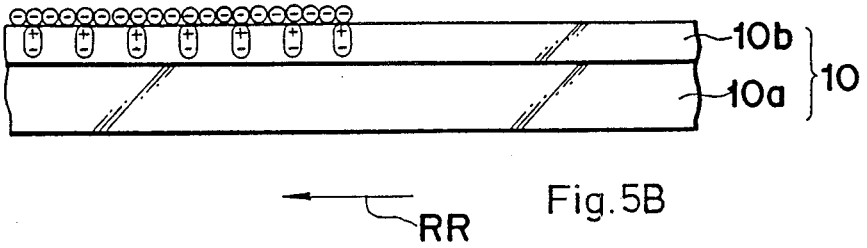
Fig. 5B

Fig.10
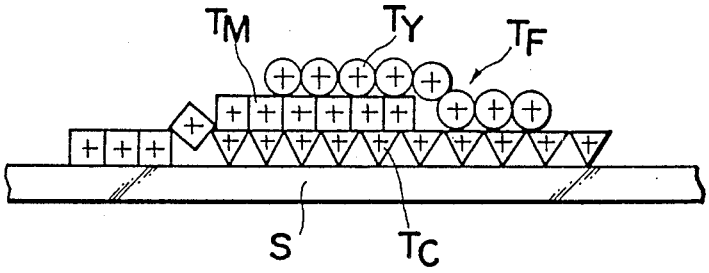
Fig.12
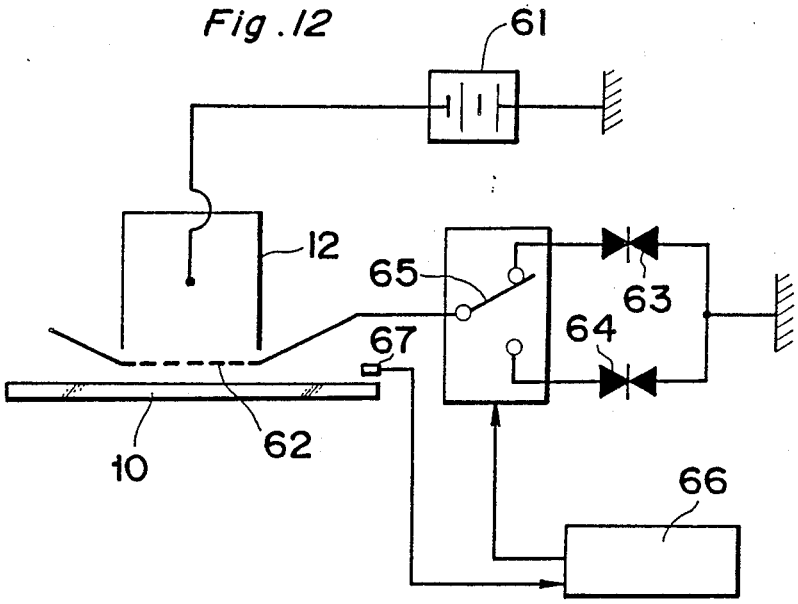
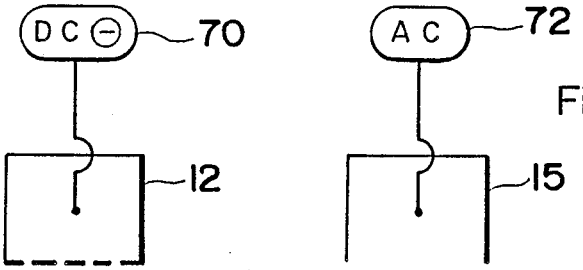
Fig.13A
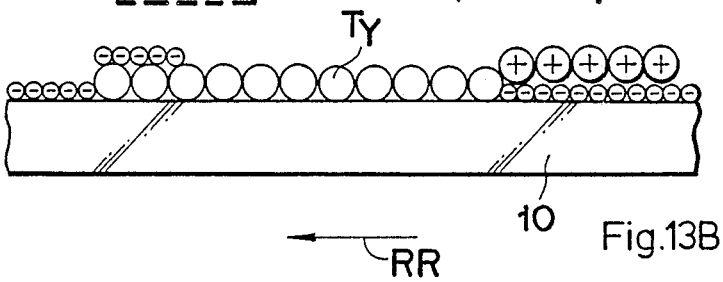
Fig.13B

Fig. 14
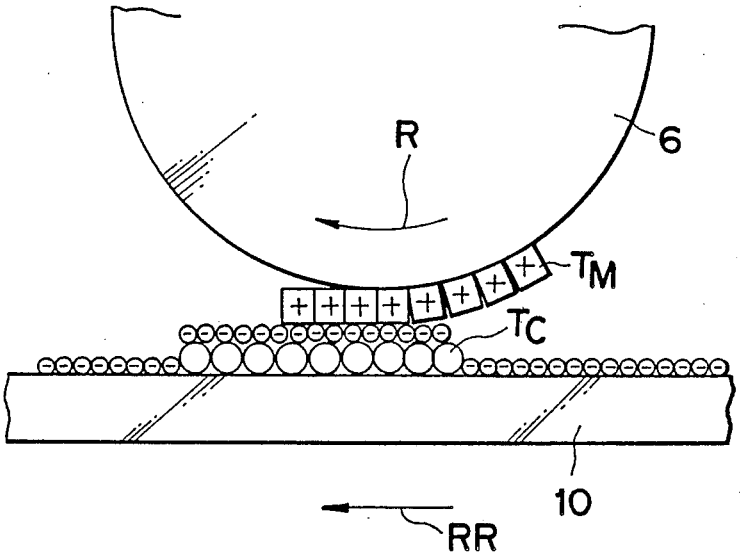
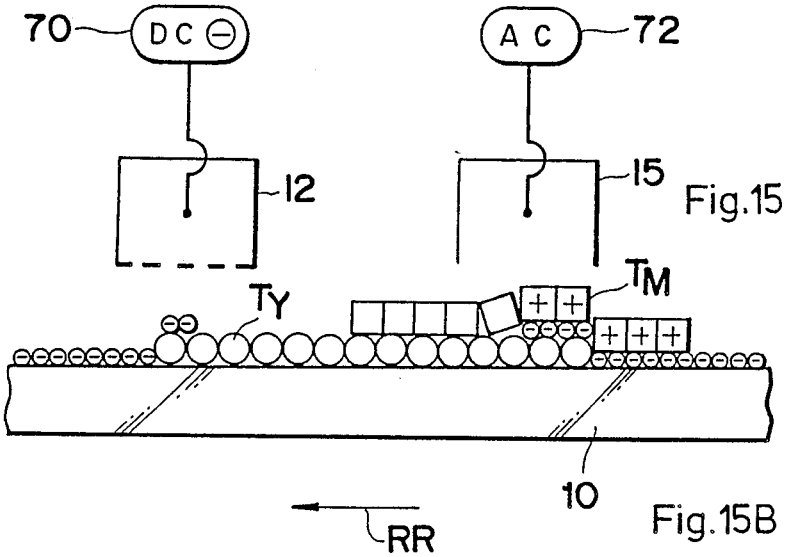
Fig.15A
Fig.15B

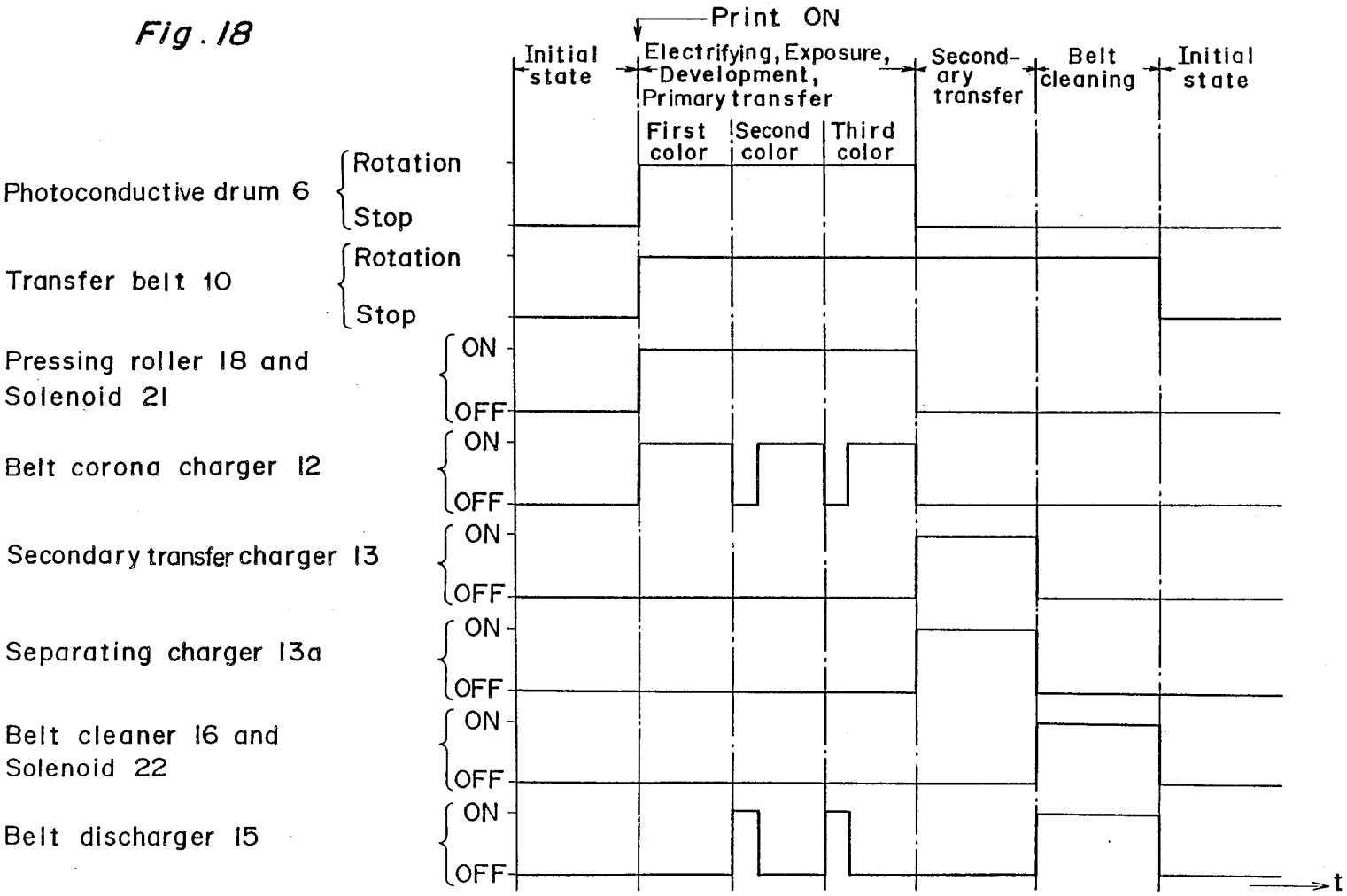
Fig. 18
Print ON
Initial state
Electrifying, Exposure, Development, Primary transfer
First color
Second color
Third color
Secondary transfer
Belt cleaning
Initial state
t
Photoconductive drum 6
Rotation
Stop
Transfer belt 10
Rotation
Stop
Pressing roller 18 and Solenoid 21
ON
OFF
Belt corona charger 12
ON
OFF
Secondary transfer charger 13
ON
OFF
Separating charger 13a
ON
OFF
Belt cleaner 16 and Solenoid 22
ON
OFF
Belt discharger 15
ON
OFF

COLOR IMAGE FORMING METHOD

BACKGROUND OF THE INVENTION

1. Field of the Invention

The present invention relates to a color image forming method, and more particularly, to a color image forming method with use of a toner image retaining member for retaining a toner image temporarily.

2. Description of the Related Art

A method and apparatus for transferring two toner images on both sides of a copying paper respectively at the same time are disclosed in the Japanese patent publication (JP-B2) No. 54-28740 . In the method and apparatus, a first toner image is formed on a photoconductive body at first and the toner image having been formed is transferred on a toner image retaining member primarily. After the transfer of the first toner image onto the toner image retaining member, a second toner image is formed on the photoconductive body. Furthermore, the first toner image transferred primarily from the photoconductive body onto the toner retaining member and the second toner image formed newly on the photoconductive body are respectively transferred on both sides of a copying paper simultaneously to produce a copy of both sides. However, since an insulator belt is usually used on the toner image retaining member and the toner image formed on the photoconductive body is transferred on the insulator belt by a transfer charger arranged on the back side of the insulator belt, it is difficult to concentrate the action of the transfer charger at the transfer where the photoconductive body and the insulator belt are in contact with each other, and therefore, portions of the photoconductive body no having passed the transfer position receive undesirable affects from the transfer charger. As a result, the toner image may be spoiled.

Also, a transferring image forming method and a transferring image forming apparatus are disclosed in the Japanese patent laid open publication (P-A) No. 56-147166. In the method and apparatus, in order to form a plurality of toner images based on a formed electrostatic latent image, after the toner image formed on a charge retaining drum is transferred on an insulator belt primarily by pressing the charge retaining drum onto the insulator belt, the toner image transferred on the insulator belt is transferred on a copying paper secondarily.

Furthermore, an electrophotographic process of transferring colored electrostatic images is disclosed in the Japanese patent publication (JP-B2) No. 49-209. In the electrophotographic process, after respective colors of toner images formed on a photoconductive body are transferred primarily onto a toner image retaining drum sequentially in multiple processes so as to superimpose the same thereon, the toner image superimposed on the toner image retaining drum is transferred onto a copying paper secondarily. In the specification of the above publication, the primary transfer process for the toner image from the photoconductive body onto the toner image retaining drum is not described concretely.

SUMMARY OF THE INVENTION

An essential object of the present invention is to provide a color image forming method which is able to form an image of good quality at all times.

Another object of the present invention is to provide a color image forming method which is able to form respective color toner images on a photoconductive member sequentially, and also transfer these toner images on a toner image retaining member properly at all times.

According to one aspect of the present invention, there is provided a color image forming method using a toner image retaining member, said method comprising steps of: sequentially forming a plurality of electrostatic latent images corresponding to respective color components of an image of a document on a photoconductive member; sequentially developing the electrostatic latent images with respective toners of different colors so as to form the corresponding visible toner images on said photoconductive member; sequentially transferring the toner images formed on said photoconductive member onto said toner image retaining member by electrifying the surface of said toner image retaining member to have a predetermined electric potential every transfer process for each of the toner images so as to form a color image on said toner image retaining member; and transferring the color image formed on the toner image retaining member onto a paper.

According to another aspect of the present invention, there is provided a color image forming method using a toner image retaining member, said method comprising steps of: sequentially forming a plurality of electrostatic latent images corresponding to respective color components of an image of a document on a photoconductive member; sequentially developing the electrostatic latent images with respective toners of different colors so as to form the corresponding visible toner images on said photoconductive member; sequentially transferring the toner images formed on said photoconductive member onto said toner image retaining member by electrifying the surface of said toner image retaining member to have a predetermined electric potential every transfer process for each of the toner images after erasing the charge on said toner image retaining member, so as to form a color image on said toner image retaining member; and transferring the color image formed on the toner image retaining member onto a paper.

According to a further aspect of the present invention, there is provided a color image forming method using a toner image retaining member, said method comprising steps of: forming a first electrostatic latent image corresponding to a first color component of an image of a document on a photoconductive member; developing the first electrostatic latent image with a first toner of the first color so as to form a first visible toner image on said photoconductive member; transferring the first toner image formed on said photoconductive member onto said toner image retaining member by electrifying the surface of said toner image retaining member and bringing the electrified surface thereof into contact with the photoconductive member; forming a second electrostatic latent image corresponding to a second color component of the image of the document on said photoconductive member; developing the second electrostatic latent image with a second toner of the second color so as to form a second visible toner image on said photoconductive member; transferring the second toner image formed on the photoconductive member onto the toner image retaining member by selectively electrifying the surface of the toner image retaining member again to keep a predetermined electric potential and bringing the electrified surface into contact with the photoconductive member, so as to form a composite image comprised of the first and second toner images on said toner image retaining member; and transferring the composite image formed on said toner image retaining member onto a paper.

According to a still further aspect of the present invention, there is provided a color image forming method using a toner image retaining member, said method comprising steps of: forming a first electrostatic latent image corresponding to a first-color component of an image of a document on a photoconductive member; developing the first electrostatic latent image with a first toner of the first color so as to form a first visible toner image on said photoconductive member; transferring the first toner image formed on said photoconductive member onto said toner image retaining member by electrifying the surface of said toner image retaining member and bringing the electrified surface thereof into contact with the photoconductive member; forming a second electrostatic latent image corresponding to a second color component of the image of the document on said photoconductive member; developing the second electrostatic latent image with a second toner of the second color so as to form a second visible toner image on said photoconductive member; transferring the second toner image formed on the photoconductive member onto the toner image retaining member by selectively electrifying the surface of the toner image retaining member again to keep a predetermined electric potential after erasing the charge on said toner image retaining member and bringing the electrified surface into contact with the photoconductive member, so as to form a composite image comprised of the first and second toner images on said toner image retaining member; and transferring the composite image formed on said toner image retaining member onto a paper.

BRIEF DESCRIPTION OF THE DRAWINGS

These and other objects and features of the present invention will become clear from the following description taken in conjunction with the preferred embodiments thereof with reference to the accompanying drawings, in which:

FIG. 2 is a perspective view showing a color filter unit shown in FIG. 1;

FIG. 4 is a partial cross sectional view of the intermediate transfer belt shown in FIGS. 1 and 3;

FIGS. 5A and 5B are an enlarged longitudinal cross sectional views showing an electrifying state of the intermediate transfer belt shown in FIGS. 1, 3 and 4;

FIG. 10 is an enlarged partial cross sectional view of a copying paper on which a full color image has been transferred;

FIG. 12 is a schematic diagram showing a system for electrifying the intermediate transfer belt of the second preferred embodiment according to the present invention;

FIGS. 13A and 13B are and enlarged longitudinal cross sectional views for showing discharge and electrifying actions to be done at the primary transfer position PT before the primary transfer process for the second time in a full color copying machine of the third preferred embodiment according to the present invention;

FIG. 14 an enlarged longitudinal cross sectional view for showing a primary transfer process for the second time to be done at the primary transfer position PT in the full color copying machine of the third preferred embodiment;

FIGS. 15A and 15B are enlarged longitudinal cross sectional views showing discharge and electrifying actions of the intermediate transfer belt to be done before the primary transfer process for the third time in the full color copying machine of the third preferred embodiment;

FIG. 18 is a timing chart showing actions of the full color copying machine of the third preferred embodiment.

DETAILED DESCRIPTION OF THE PREFERRED EMBODIMENTS

THE FIRST PREFERRED EMBODIMENT

A full color copying machine of the first preferred embodiment according to the present invention will be described hereinafter, referring to the attached drawings.

Figure 1:
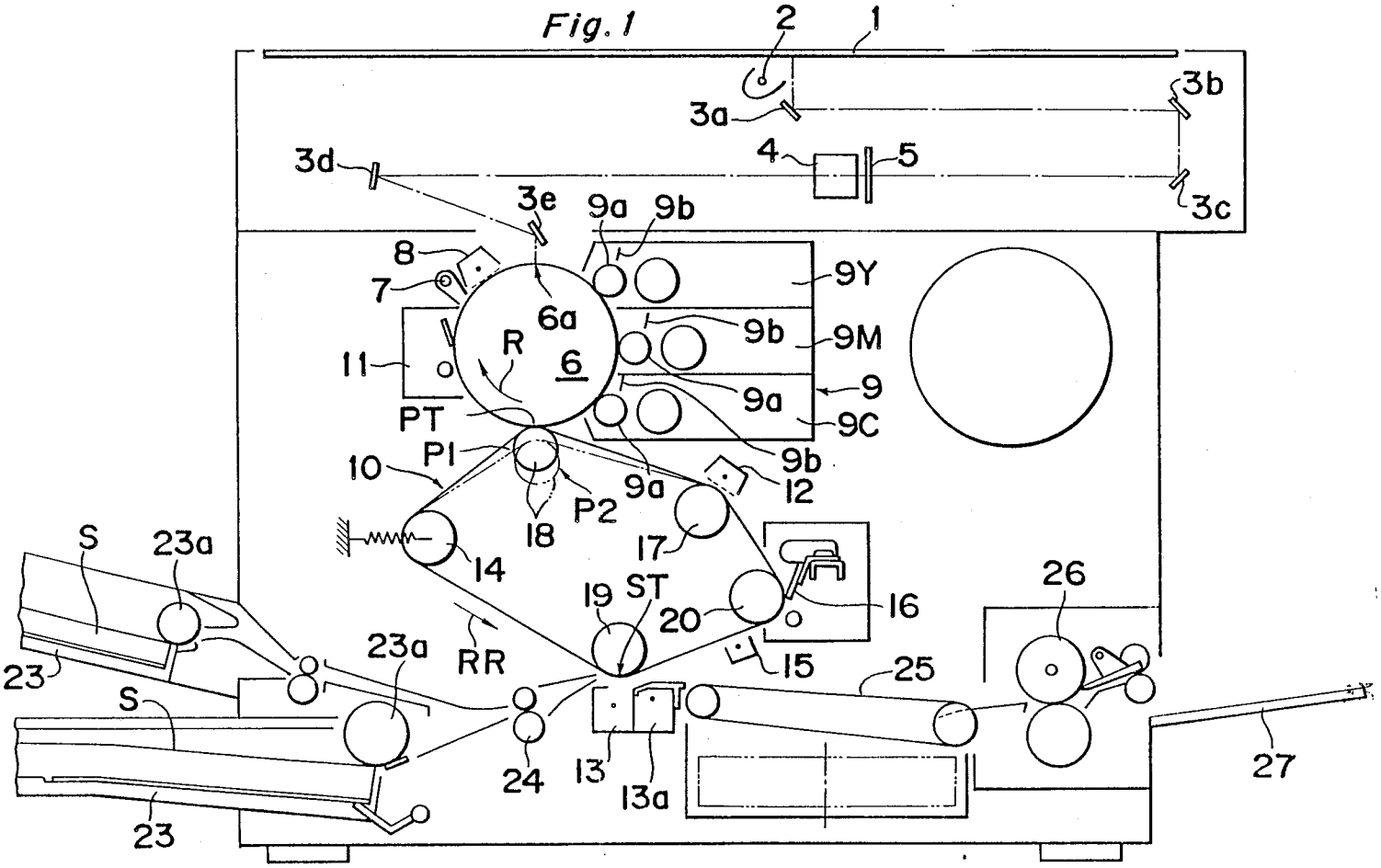
FIG. 1. is a schematic longitudinal cross sectional view showing a full color copying machine of the first preferred embodiment according to the present invention.

In FIG. 1, under a glass document table 1 for arranging a document thereon, there are arranged an optical system comprised of an exposure lamp 2 for illuminating the document arranged on the glass document table 1, first to fifth mirrors 3*a* to 3*e* for guiding a light reflected by the document, a focus lens 4 for focusing the above light passed through a color filter unit 5 onto the fourth mirror 3 *d*, and the color filter unit 5. A photoconductive drum 6 is arranged under the fifth mirror 3*e*. As shown in FIG. 2, the color filter unit 5 is comprised of a blue color filter plate 5B for filtering off a color component of yellow, a green color filter plate 5G for filtering off a color component of magenta, and a red color filter plate 5R for filtering off a color component of cyan, which are supported by a frame member 51 in a vertical plane perpendicular to the optical axis of the focus lens 4. The frame member 51 for supporting the filter plates 5B, 5G and 5R is moved by a driving motor 52 in directions indicated by arrows A and B as shown in FIG. 2, so that selected one of the filter plates 5B, 5G and 5R is positioned on the way of the optical path between the third mirror 3*c* and the focus lens 4 according to position information detected by position sensors 53a and 53b.

Returning now to FIG. 1, around the photoconductive drum 6, there are arranged an eraser lamp 7, a corona charger 8, a developing section 9, an intermediate transfer belt 10, and a drum cleaner 11, sequentially in a rotation direction of the photoconductive drum 6 indicated by an arrow R. The developing section 9 is comprised of a yellow developing unit 9Y, a magenta developing unit 9M, and a cyan developing unit 9C. Furthermore, respective developing units 9Y, 9M and 9C comprise a developing sleeve 9 a for supplying each color toner, a scraping shutter member 9b arranged at the rear of the developing sleeve 9a for scraping off the toner supplied on the developing sleeve 9a when the developing unit is not selected as described later in detail, and a toner density detector (not shown) etc. in a known manner.

As shown in FIG. 4, the intermediate transfer belt 10 is constituted by a flexible looped endless belt comprised of an electrically conductive substrate 10a of urethane rubber having a volume resistivity of $10^3$ to $10^4$ Ω.cm, and a dielectric layer 10b of polytetrafluorethylene having a volume resistivity equal to or larger than $10^{14}$ Ω.cm which is formed on the upper surface of the conductive substrate 10a.

According to an experiment done by the present inventors, when the specific inductive capacity of the dielectric layer 10b is equal to or smaller than 2 and the volume resistivity thereof is equal to or smaller than $10^{16}$Ω.cm, the ability for retaining the electric charge is lowered, resulting in that the electric charge retained on the dielectric layer 10b discharges immediately after the electrifying operation Further, when the specific inductive capacity of the dielectric layer 10b is equal to or smaller than 4 and the volume resistivity thereof is equal to or larger than $10^{17}$ Ωcm, the efficiencies of the electrifying and discharge actions are lowered, resulting in that it becomes hard to electrify or discharge the intermediate transfer belt 10. Furthermore, when the volume resistivity of the conductive substrate 10a is equal to or larger than $10^4$ Ωcm, the conductivity thereof is lowered and the intermediate transfer belt 10 is electrified ununiformly and unstably, resulting in that there are such inconveniences that the drop of the electric potential thereof decreases when a toner image is transferred thereon.

Accordingly, the specific inductive capacity of the dielectric layer 10b is preferably in the range from 2 to 4, the volume resistivity thereof is preferably in the range from $10^{16}$ to $10^{17}$ Ωcm, and the volume resistivity of the conductive substrate 10a is preferably equal to or smaller than $10^5$ Ωcm. In the intermediate transfer belt 10 comprising the conductive substrate 10a and the dielectric layer 10b satisfying the above conditions, the efficiencies of the electrifying and discharge actions are improved, and the electric charge electrified thereon can be retained stably for a relatively long time without any influence of the environment. Accordingly, the intermediate transfer belt 10 can be used effectively as an intermediate transfer body.

Around the intermediate transfer belt 10, there are arranged a belt corona charger 12 for transferring an image formed on the photoconductive drum 6 onto the intermediate transfer belt 10 in the primary transfer process, a secondary transfer charger 13 for transferring an image formed on the intermediate transfer belt 10 onto a copying paper S, a separating charger 13a, a belt discharger 15, and a belt cleaner 16.

Figure 3:
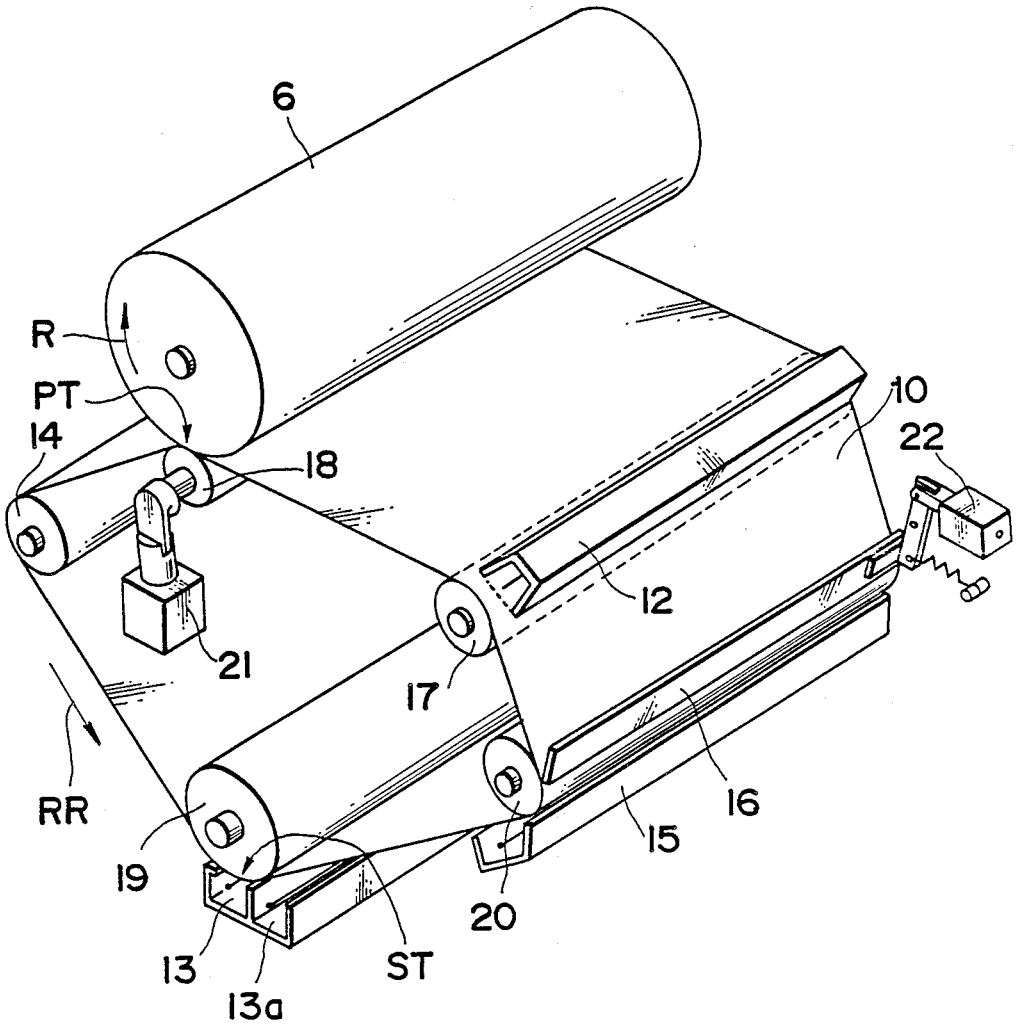
FIG. 3 is a perspective view showing an intermediate transfer belt and devices arranged therearound shown in FIG. 1.

Furthermore, as shown in FIG. 3, the intermediate transfer belt 10 is tensed by five cylindrical rollers comprised of a belt charger roller 17 arranged so as to oppose to the belt corona charger 12, a pressing roller 18 arranged so as to oppose to the photoconductive drum 6, a secondary transfer roller 19, a belt cleaner roller 20, and a tension roller 14, so that the dielectric layer 10b of the belt 10 opposes to the photoconductive drum 6. The pressing roller 18 is moved by a solenoid 21 between a first position Pl for pressing the intermediate transfer belt 10 onto the surface of the photoconductive drum 6 at a primary transfer position PT and a second position P2 for keeping the intermediate transfer belt 10 apart from the photoconductive drum 6. The belt cleaner 16 is moved by a solenoid 22 between a first position for contacting with the intermediate transfer belt 10 and a second position at which the belt cleaner 16 is kept apart from the intermediate transfer belt 10.

Paper feeding cassettes 23 for feeding a copying paper S are arranged on the left hand side of the secondary transfer charger 13, and the copying paper S sent by a paper feeding roller 23a is sent by a timing roller 24 to a secondary transfer position ST of the intermediate transfer belt 10 positioned above the secondary transfer charger 13. A copying paper transportation belt 25 is arranged on the right hand side of the secondary transfer charger 13 and the separating charger 13a, and the copying paper S after the secondary transfer process is transported to a fixing unit 26 by the copying paper transportation belt 25. After the fixing unit 26 fixes the toner image transferred on the copying paper S, the copying paper S is discharged onto a paper tray 27.

Actions of the full color copying machine constructed as described above will be described hereinafter.

The document set on the glass document table 1 is scanned by the optical scanner in a horizontal direction, and the light reflected by the document is incident onto a photoconductive surface 6a of the rotating photoconductive drum 6 via the first to third mirrors 3a to 3c, the color filter unit 5, the focus lens 4, and the fourth and fifth mirrors 3d and 3e, to form a latent image of the document. Upon forming the latent image, the surface 6a of the photoconductive drum 6 is exposed to discharge it by the eraser lamp 7, and is electrified to have a predetermined electric potential such as a negative electric potential by the corona charger 8. When it is exposed to the above light reflected by the document in the electrified state while the photoconductive drum 6 is rotated in the clockwise direction indicated by the arrow R as shown in FIG. 1 in synchronous with the above scan operation, the electric potential of the photoconductive surface 6a varies according to the intensity thereof, resulting in that an electrostatic latent image corresponding to a color image of the document filtered by either one of the filter plates 5B, 5G and 5R of the color filter unit 5 is formed thereon.

Then, the electrostatic latent image is developed in a visible color toner image with a color toner supplied from the selected one of the yellow developing unit 9Y, the magenta developing unit 9M, and the cyan developing unit 9C. For example, when the blue color filter plate 5B of the color filter unit 5 is positioned on the way of the aforementioned optical path, the yellow developing unit 9Y for supplying the yellow toner being complementary to blue color is selected. Then, in the other developing units 9M and 9C not selected, toner supplied on the developing sleeve 9*a* is scraped off by the scraping shutter member 9*b* arranged at the rear of the developing sleeve 9*a* so as not to be supplied to the photoconductive drum 6. Thereafter, when the selected yellow developing unit 9Y is driven so as to supply a yellow toner to the surface of the photoconductive drum 6, the above electrostatic latent image is developed in a visible yellow toner image. It is to be noted that the toner to be supplied to the photoconductive drum 6 is previously electrified to have a predetermined electric potential such as a positive electric potential, which is opposite to that of the photoconductive drum 6.

The intermediate transfer belt 10 is driven in a direction indicated by an arrow RR in synchronism with the rotation of the photoconductive drum 6 at the same velocity as the rotation velocity of the photoconductive drum 6, and when the intermediate transfer belt 10 passes through the belt corona charger 12 positioned before the primary transfer position PT, it is electrified as shown in FIGS. 5A and 5B. A negative voltage is applied to the belt corona charger by a direct-current voltage source 70, so that the dielectric layer 10*b* of the intermediate transfer belt 10 is electrified to have a negative electric potential. In the electrifying operation, since the surface of the dielectric layer 10*b* is directly electrified, it can be done at a high efficiency. A negative electric potential is formed uniformly on the surface of the dielectric layer 10*b* by the above electrifying operation. This state is stabilized by a backup of the conductive substrate 10*a* formed at the back side of the dielectric layer 10*b*, and the above state can be maintained for a relatively long time without any influence of the environment.

On the other hand, at the primary transfer position PT, the pressing roller 18 presses the intermediate transfer belt 10 on the photoconductive drum 6 by the action of the solenoid 21.

Figure 6:
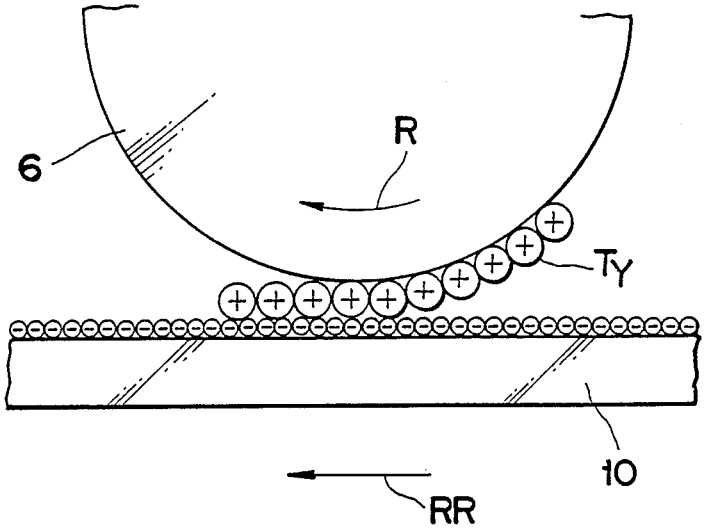
FIGS. 6 to 8 are enlarged partial cross sectional views for showing a primary transfer process of respective color toner images at a primary transfer position PT in the full color copying machine shown in FIG. 1.

When an electrified portion of the intermediate transfer belt 10 reaches the primary transfer position PT in the above state, the yellow toner image $T_Y$ having a positive electric potential is transferred from the photoconductive drum 6 onto the intermediate transfer belt 10 having the negative electric potential electrified, as shown in FIG. 6. The above transfer process is performed without the action of the corona charger 12 because the corona charger 12 is remote from the primary transfer position PT, however, the toner image is transferred due to the stabilized electric potential given to the intermediate transfer belt 10 without any jitter of image due to the previous transfer process. Thereafter, the photoconductive surface 6*a* of the photoconductive drum 6 is cleaned by the drum cleaner 11, and thereby, the primary transfer process is completed.

Figure 7:
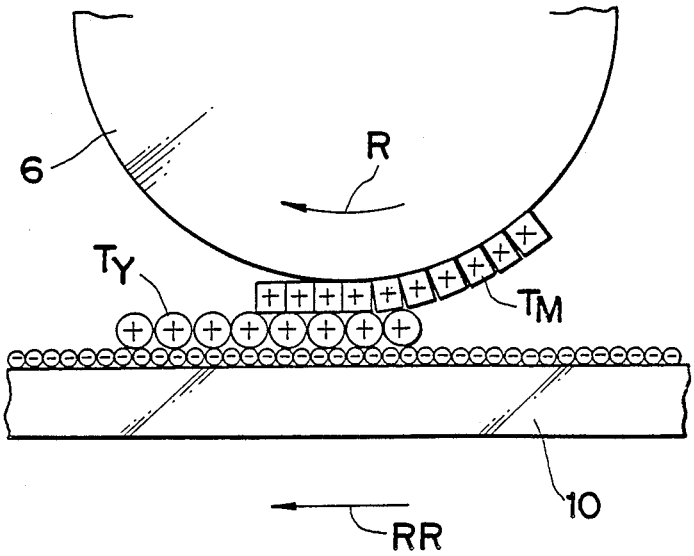

In the case of a full color copying operation, after the process for the first time comprised of the exposure, the development and the primary transfer with respect to the yellow image of the document is completed, the green color filter plate 5G of the color filter unit 5 is selected so as to be positioned on the way of the aforementioned optical path, the photoconductive surface 6*a* of the photoconductive drum 6 is exposed to a light passed through the green color filter plate 5G so that an electrostatic latent image corresponding to a magenta component of the document image is formed thereon. The electrostatic latent image is developed in a visible magenta toner image by the magenta developing unit 9M for supplying the magenta toner being the complementary color of green light. At the same time, the intermediate transfer belt 10 on which the yellow toner image $T_Y$ has been formed is electrified by the belt corona charger 12, and then, the intermediate transfer belt 10 is pressed on the photoconductive drum 6 again, so that the magenta toner image $T_M$ is transferred onto the yellow toner image $T_Y$ as shown in FIG. 7 as well as the primary transfer process for the yellow toner image $T_Y$, because the electric potential of the intermediate transfer belt 10 is returned to a predetermined value by the belt corona charger 12 as described above.

Figure 8:
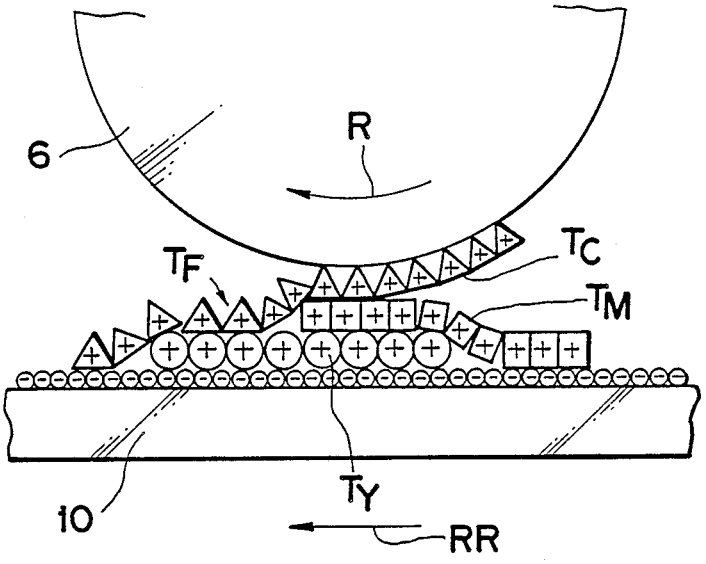

After the aforementioned process for the second time comprised of the exposure, the development and the primary transfer with respect to the magenta image of the document is completed, the third red color filter plate 5R of the color filter unit 5 is selected so as to be positioned on the way of the aforementioned optical path, the photoconductive surface 6*a* of the photoconductive drum 6 is exposed to a light passed through the red color filter plate 5R so that an electrostatic latent image corresponding to a cyan component of the document image is formed thereon. The electrostatic latent image is developed in a visible cyan toner image by the cyan developing unit 9C for supplying the cyan toner being the complementary color of red light. At the same time, the intermediate transfer belt 10 is electrified by the corona charger 12 once more, and then, the intermediate transfer belt 10 on which the yellow toner image $T_Y$ and the magenta toner image $T_M$ are transferred is pressed on the photoconductive drum 6 again, so that the cyan toner image $T_C$ is formed on the yellow and magenta toner images $T_Y$ and $T_M$ as shown in FIG. 8 as well as the above primary transfer process for the toner images $T_Y$ and $T_M$, because the electric potential of the intermediate transfer belt 10 is refreshed to have the predetermined value by the belt corona charger 12 as described above, resulting in that the full color toner image $T_F$ comprised of the yellow, magenta and cyan toner images $T_Y$, $T_M$ and $T_C$ is formed thereon.

During the above primary transfer process, the solenoid 22 is turned off so that the belt cleaner 16 is kept apart from the intermediate transfer belt 10. On the other hand, at a timing when the above primary transfer process is completed, the solenoid 21 is turned off so that the pressing roller 18 is moved to detach the intermediate transfer belt 10 from the photoconductive drum 6, and then, the intermediate transfer belt 10 is driven to rotate in the direction indicated by the arrow RR in this state. Thus, since the intermediate transfer belt 10 is detached from the photoconductive drum 6 except for the primary transfer process, the rotation operation of the photoconductive drum 6 is stopped when the primary transfer process has been completed. Since the photoconductive drum 6 is kept apart from the intermediate transfer belt 10, it can be prevented from being marred and the electrical fatigue can be prevented due to the friction which might cause the electrifying and discharge of the photoconductive drum 6 repeatedly if they were contacted with each other.

Figure 9:
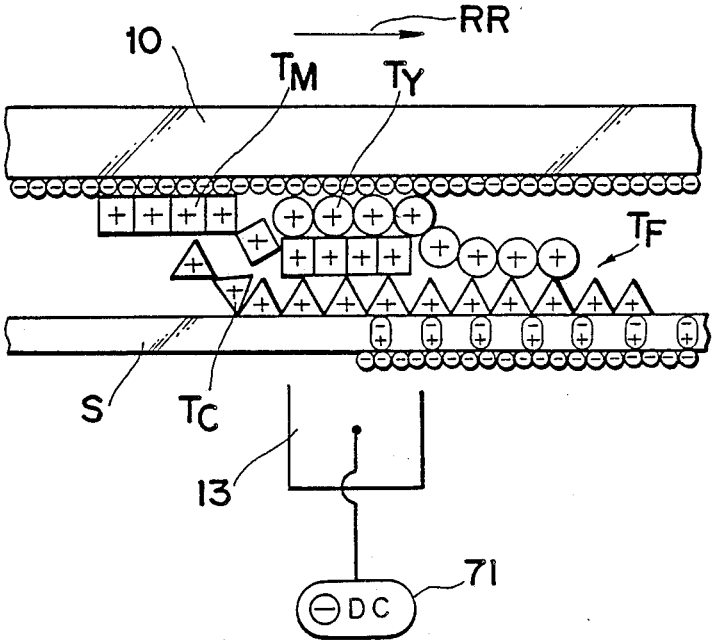
FIG. 9 is an enlarged partial cross sectional view for a secondary transfer process of a full color toner image at a secondary transfer position ST in the full color copying machine shown in FIG. 1.

On the other hand, at a predetermined timing when a signal is outputted from a position detection unit (not shown) for detecting the position of the intermediate transfer belt 10, a copying paper S is sent from the paper feeding cassette 23 by paper feeding roller 23*a*, and then, at the next predetermined timing, the copying paper S is sent to the secondary transfer position ST positioned above the secondary transfer charger 13 by the timing roller 24. At that time, the copying paper S is electrified to have a negative electric potential by the secondary transfer charger 13 to which a negative direct-current voltage is applied by a voltage source 71 as shown in FIG. 9, and then, the full color toner image $T_F$ having a positive electric potential which is formed on the intermediate transfer belt 10 is absorbed electrostatically and thereby, transferred onto the copying paper S.

After an alternating-current voltage is applied by the separating charger 13*a* to the copying paper S on which the toner image $T_F$ is transferred as shown in FIG. 10 so that the copying paper S is discharged, the copying paper S is separated from the intermediate transfer belt 10, and is absorbed and is transported by the copying paper transportation belt 25. Thereafter, the copying paper S is sent to the fixing unit 26, and the toner image $T_F$ formed on the copying paper S is fixed, and then, the copying paper S is exhausted to the paper tray 27.

On the other hand, after the secondary transfer process is completed, the intermediate transfer belt 10 is discharged by the belt discharger 15, and is cleaned by the belt cleaner 16 when the solenoid 22 is turned on, and then, the intermediate transfer belt 10 becomes in a standby state for the next process.

Figure 11:
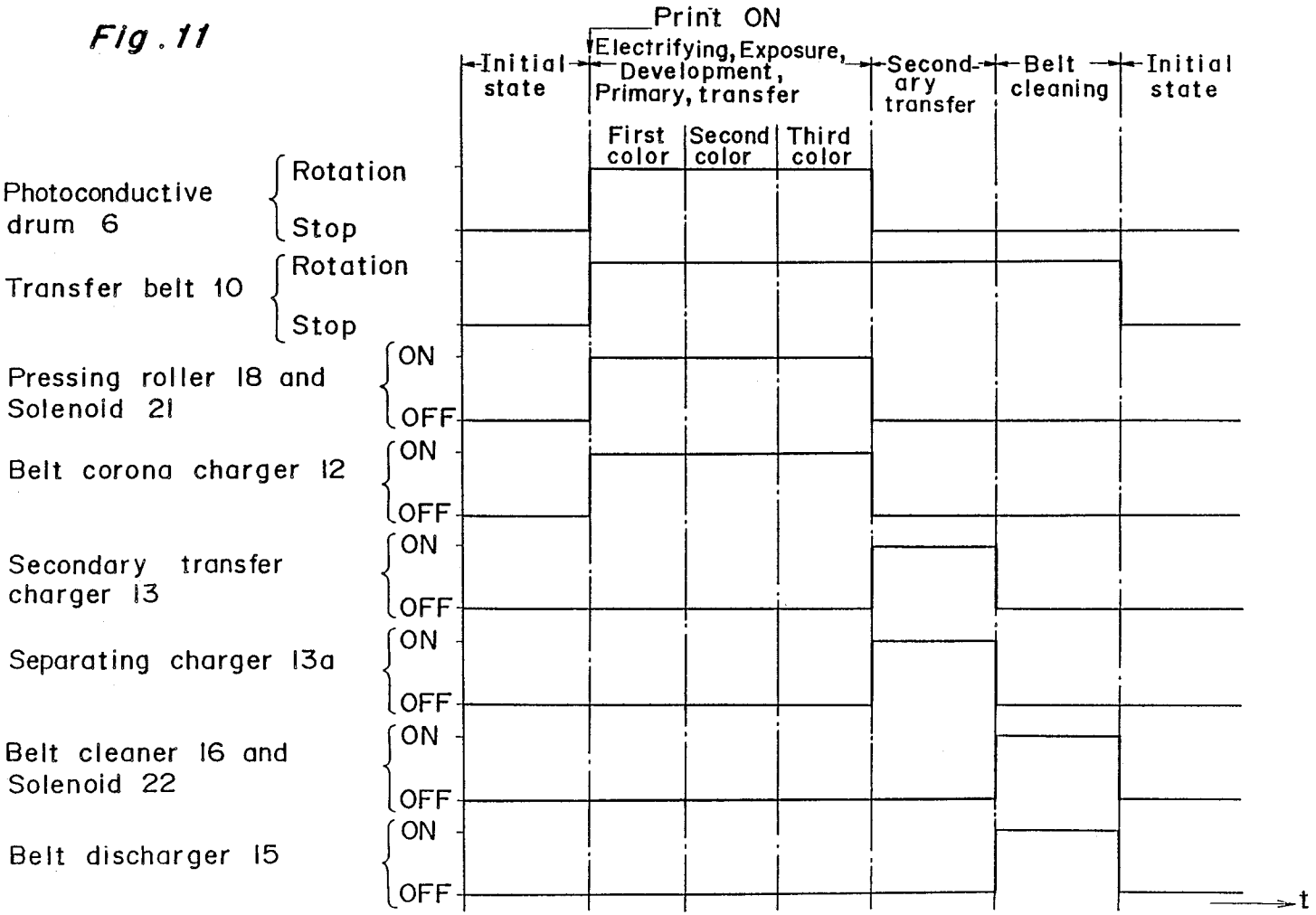
FIG. 11 is a timing chart showing actions of the full color copying machine shown in FIG. 1.

The operation timings of the photoconductive drum 6, the intermediate transfer belt 10, the solenoids 21 and 22, the belt cleaner 16, respective chargers 12, 13, 13*a* and 15, and the pressing roller 18 are shown in FIG. 11.

In the present preferred embodiment, when respective images are transferred on the intermediate transfer belt 10 in the above multiple transfer proeess, the intermediate transfer belt 10 is electrified every primary transfer process so that an electric potential required for the primary transfer process is ensured on the intermediate transfer belt 10. However, the electrifying action to be repeated may be performed preferably so that the electric potential of the intermediate transfer belt 10 can be refreshed to the predetermined value. Because a so-called reverse transfer can be prevented which may be caused when only the intermediate transfer belt 10 is electrified again (referred to as a reelectrifying operation hereinafter) in case of the multiple transfer process. Namely, when only the intermediate transfer belt 10 is electrified again, not only the intermediate transfer belt 10 but also the toner images are electrified, the reverse transfer may be caused wherein the toner images are transferred back onto the photoconductive drum 6 by a repulsion force acting between the toner images and the intermediate transfer belt 10 having the same polarity as each other. However, when the intermediate transfer belt 10 is electrified again so that the electric potential thereof is refreshed to a value equal to or larger than the predetermined value, the toner images having a positive electric potential formed on the intermediate transfer belt 10 may be hardly influenced by the electrification thereof, resulting in that the aforementioned reverse transfer can be prevented.

Furthermore, it is not necessary to electrify the intermediate transfer belt 10 again for maintaining the electric potential thereof equal to or larger than a predetermined value, every primary transfer process after the primary transfer process for the first time. Only when the electric potential of the intermediate transfer belt 10 is smaller than a predetermined value, it may be electrified again so that the electric potential thereof can be returned to a value equal to or larger than the predetermined value. Such a system will be described below in the second preferred embodiment in detail.

THE SECOND PREFERRED EMBODIMENT

FIG. 12 is a schematic diagram showing the system for electrifying the intermediate transfer belt 10 of the second preferred embodiment according to the present invention, which is capable of changing the electric potential of the intermediate transfer belt 10 upon electrifying it again.

The belt corona charger 12 is connected to a high voltage transformer 61 for applying a negative voltage thereto. On the other hand, a scorotron mesh 62 is connected to terminals of two varistors 63 and 64 through a switch 65, and another terminals thereof are connected to ground. The varistors 63 and 64 are used for stabilizing the bias voltage of the mesh 62 low or high. When the varistor 63 is connected to the mesh 62, the bias voltage of the mesh 62 is set to a high voltage so that the electric potential of the intermediate transfer belt 10 is electrified to have a high value by the belt corona charger 12. On the other hand, When the varistor 64 is connected to the mesh 62, the bias voltage of the mesh 62 is set to a low voltage so that the electric potential of the intermediate transfer belt 10 is electrified to have a low value by the belt corona charger 12. The switch 65 is controlled by a microcomputer 66 for controlling the operation of the full color copying machine. Namely, the electric potential thereof can be switched over between the high and low values by the microcomputer 66.

The microcomputer 66 switches the switch 65 so that the belt corona charger 12 electrifies the intermediate transfer belt 10 to have the high electric potential in the primary transfer process for the first time. In the primary transfer process for the second time or more, the microcomputer 66 switches the stitch 65 so that the belt corona charger 12 electrifies the intermediate transfer belt 10 to have the low electric potential, after the electric potential of the belt 10 decreases by a predetermined value.

Furthermore, a sensor 67 for measuring the electric potential of the intermediate transfer belt 10 may be connected to the microcomputer 66 as shown in FIG. 12. In this case, after the primary transfer process for the first time or more, only when the electric potential of the belt 10 is equal to or smaller than a predetermined value, the intermediate transfer belt 10 can be electrified to have the low electric potential by the belt corona charger 12, so that the electric potential of the belt 10 is refreshed to a value equal to or larger than a predetermined value. In this case, when the electric potential electrified by the belt corona charger 12 is switched over among two and more stages of voltages, the electric potential for the reelectrifying operation can be changed to various voltages according to the decrease of the electric potential of the intermediate transfer belt 10.

THE THIRD PREFERRED EMBODIMENT

FIG. 18 is a timing chart showing an operation of a full color copying machine of the third preferred embodiment according to the present invention. As compared with the operation of the first preferred embodiment shown in FIG. 11, the full color copying machine of the third preferred embodiment is characterized in that, in the primary transfer process for the second time or more, as shown in FIGS. 13A and 13B, after the intermediate transfer belt 10 and the yellow toner image $T_Y$ are discharged by the discharger 15 in order to prevent the aforementioned reverse transfer, the belt 10 is electrified again by the belt corona charger 12.

The differences between the third and first preferred embodiments will be mainly described hereinafter in detail.

It is to be noted that, in the present preferred embodiment, the full color copying machine has essentially the same construction as that of the full color copying machine of the first preferred embodiment shown in FIGS. 1 to 4.

In the present preferred embodiment, as described above, in the primary transfer process for the second time or more, as shown in FIGS. 13A and 13B, after the intermediate transfer belt 10 and the yellow toner image $T_Y$ are discharged by the discharger 15 to which an alternating-current voltage is applied by an alternating-current power source 72 in order to prevent the aforementioned reverse transfer, the belt 10 is electrified again by the belt corona charger 12. Accordingly, a predetermined negative electric potential is applied uniformly to the exposure surface of the intermediate transfer belt 10 and the yellow toner image $T_Y$ by the reelectrifying action as shown in FIG. 13, however, the portion of the surface of the intermediate transfer belt 10 which is covered by the yellow toner image $T_Y$ is hardly electrified. Due to this, when the intermediate transfer belt 10 is in contact with the photoconductive drum 6 during the primary transfer process for the second time as shown in FIG. 14, such a reverse transfer of the yellow toner image $T_Y$ can be prevented by a repulsion force due to the fact that the intermediate transfer belt 10 and the toner image $T_Y$ have the same polarity. Furthermore, the magenta toner image $T_M$ formed on the photoconductive drum 6 can be transferred certainly onto the intermediate transfer belt 10 and the yellow toner image $T_Y$.

Figure 16:
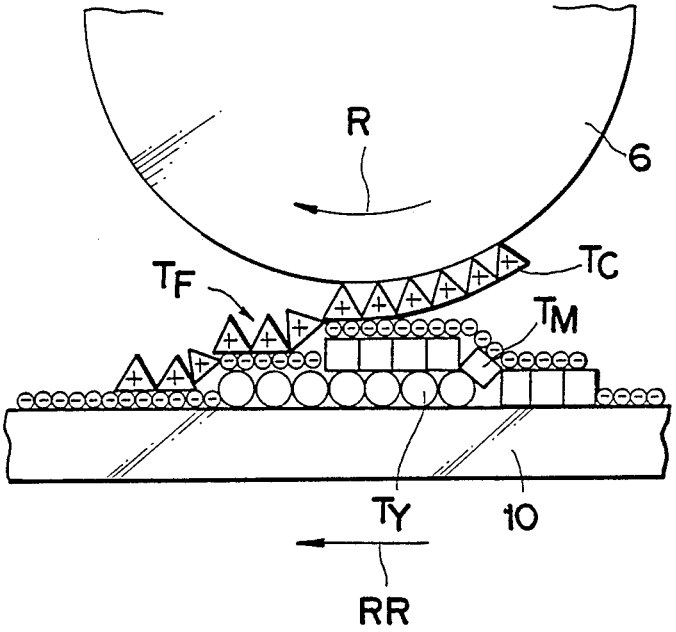
FIG. 16 is an enlarged partial cross sectional view for showing the primary transfer process for the third time to be done at the primary transfer position PT in the full color copying machine of the third preferred embodiment.

After the aforementioned process for the second time including the exposure, the development and the primary transfer with respect to the magenta image of the document is completed, the third red color filter plate 5R of the color filter unit 5 is selected so as to be positioned on the way of the aforementioned optical path, the photoconductive surface 6a of the photoconductive drum 6 is exposed to an image light having been passed through the red color filter plate 5R so that an electrostatic latent image corresponding to the cyan component of the document image is formed thereon. The electrostatic latent image is developed in a visible cyan toner image by the,, cyan developing unit 9C for supplying the cyan toner being the complementary color of red light. At the same time, the intermediate transfer belt 10 is discharged and electrified sequentially once more by the discharger 15 and the corona charger 12, respectively, as well as the electrifying operation for the second time, as shown in FIGS. 15A and 15B, and then, the intermediate transfer belt 10 on which the yellow toner image $T_Y$ and the magenta toner image $T_M$ are transferred is pressed on the photoconductive drum 6 again without the reverse transfer, so that the cyan toner image $T_C$ is superimposed on the yellow and magenta toner images $T_Y$ and $T_M$ as shown in FIG. 16 as well as the above primary transfer process of the toner image $T_M$, resulting in that the full color toner image $T_F$ comprised of the yellow, magenta and cyan toner images $T_Y$, $T_M$ and $T_C$ is formed thereon.

During the above primary transfer process, the solenoid 22 is turned off so that the belt cleaner 16 is kept apart from the intermediate transfer belt 10. On the other hand, at a timing when the above primary transfer process is completed, the solenoid 21 is turned off so that the pressing roller 18 is moved and the intermediate transfer belt 10 is detached from the photoconductive drum 6, and then, the intermediate transfer belt 10 is driven in this state. Thus, since the intermediate transfer belt 10 is pressed on the photoconductive drum 6 during the primary transfer process and it is kept apart from the photoconductive drum 6 during the other processes than the primary transfer process, the rotation operation of the photoconductive drum 6 is stopped after the primary transfer process is completed. Since the photoconductive drum 6 is kept apart from the intermediate transfer belt 10, it can be prevented from being marred and an electrical fatigue can be prevented due to the friction electrifying and discharging operation performed repeatedly.

Figure 17:
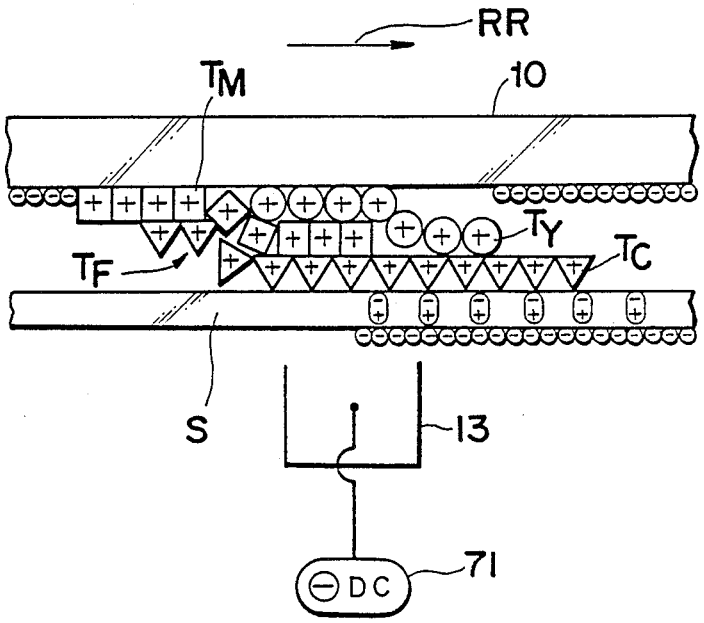
FIG. 17 is an enlarged partial cross sectional view for showing a secondary transfer process for a full color toner image to be done at the secondary transfer position ST in the full color copying machine of the third preferred embodiment.

On the other hand, at a predetermined timing when a signal is outputted from a position detection unit (not shown) for detecting the position of the intermediate transfer belt 10, a copying paper S is sent from the paper feeding cassette 23 by the paper feeding roller 23a, and then, at the next predetermined timing, the copying paper S is sent to the secondary transfer position ST positioned above the secondary transfer charger 13 by the timing roller 24. At that time, the copying paper S is electrified to have a negative electric potential by the secondary transfer charger 13 to which a negative direct-current voltage is applied as shown in FIG. 17, and then, the full color toner image $T_F$ having a positive electric potential which is formed on the intermediate transfer belt 10 is absorbed electrostatically and is transferred onto the copying paper S.

After an alternating-current voltage is applied by the separating charger 13a to the copying paper S on which the toner image $T_F$ is transferred as shown in FIG. 10 so that the copying paper S is discharged, the copying paper S is separated from the intermediate transfer belt 10, and is absorbed and is transported by the copying paper transportation belt 25. Thereafter, the copying paper S is sent to the fixing unit 26, and the toner image $T_F$ formed on the copying paper S is fixed, and then, the copying paper S is exhausted to the paper tray 27.

On the other hand, after the secondary transfer process is completed, the intermediate transfer belt 10 is discharged by the belt discharger 13, and is cleaned by the belt cleaner 16 when the solenoid 22 is turned on, and then, the intermediate transfer belt 10 becomes in a standby state for the next process.

The operation timings of the photoconductive drum 6, the intermediate transfer belt 10, the solenoids 21 and 22, the belt cleaner 16, respective chargers 12, 13, 13a and 15, and the pressing roller 18 are shown in FIG. 18.

THE OTHER MODIFICATIONS

In the above preferred embodiments, the photoconductive drum 6 and the intermediate transfer belt 10 are electrified to have a negative electric potential, and the toners are electrified to have a positive electric potential. However, the photoconductive drum 6 and the intermediate transfer belt 10 may be electrified to have a positive electric potential, and the toners may be electrified to have a negative electric potential.

In the above preferred embodiments, the primary transfer process is performed three times on the intermediate transfer belt 10 so that the full color toner image $T_F$ is formed thereon, and the full color toner image $T_F$ is transferred onto the copying paper S. However, a color image having a single color may be formed thereon and the color image may be transferred on a copying paper S.

In the above preferred embodiments, the intermediate transfer belt 10 is used as an intermediate transfer body, however, an intermediate transfer drum can be used in place of it.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A color image forming method using a toner image retaining member, said method comprising steps of:

sequentially forming a plurality of electrostatic latent images corresponding to respective color components of an image of a document on a photoconductive member;

sequentially developing the electrostatic latent images with respective toners of different colors electrically charged with a predetermined polarity so as to form the corresponding visible toner images on said photoconductive member;

electrically charging a surface of said toner image retaining member with a polarity opposite to that of said respective toners;

sequentially transferring the toner images formed on said photoconductive member onto said toner image retaining member by bringing said electrically charged surface of said toner image retaining member into contact with said photoconductive member at a transfer station so as to form a color image on said toner image retaining member, the surface of said toner image retaining member being suitably electrically charged at a station apart from the transfer station before transferring the toner image in order to keep a predetermined electric potential which is necessary to transfer the toner image properly without electrically charging said surface at said transfer station; and transferring the color image formed on the toner image retaining member onto a paper.

2. The color image forming method as claimed in claim 1, wherein the surface of said toner image retaining member is electrically charged with a voltage of predetermined value before transferring each of the toner images sequentially formed on said photoconductive member onto said toner image retaining member.

3. A color image forming method using a toner image retaining member, said method comprising steps of:

sequentially forming a plurality of electrostatic latent images corresponding to respective color components of an image of a document on a photoconductive member;

sequentially developing the electrostatic latent images with respective toners of different colors electrically charged with a predetermined polarity so as to form the corresponding visible toner images on said photoconductive member;

electrically charging a surface of said toner image retaining member with a polarity opposite to that of said respective toners;

sequentially transferring the toner images formed on said photoconductive member onto said toner image retaining member by bringing said electrically charged surface of said toner image retaining member into contact with said photoconductive member at a transfer station so as to form a color image on said toner image retaining member, the surface of said toner image retaining member being suitably electrically charged at a station apart from the transfer station after erasing the charge on said toner image retaining member before transferring the toner image in order to have a predetermined electric potential which is necessary to transfer the toner image properly without electrically charging the surface at said transfer station; and transferring the color image formed on the toner image retaining member onto a paper.

4. The color image forming method as claimed in claim 3, wherein the residual charge on the toner image retaining member is erased, and then, the surface of said toner image retaining member is electrically charged with a voltage of predetermined value, before transferring each of the toner images sequentially formed on said photoconductive member onto said toner image retaining member.

5. A color image forming method using a toner image retaining member, said method comprising steps of:

forming a first electrostatic latent image corresponding to the first color component of an image of a document on a photoconductive member;

developing the first electrostatic latent image with a first toner of the first color electrically charged with a predetermined polarity so as to form a first visible toner image on said photoconductive member;

electrically charging a surface of said toner image retaining member with a polarity opposite to that of said first toner at an electrifying station;

transferring the first toner image formed on said photoconductive member onto said toner image retaining member by bringing the electrically charged surface of said toner image retaining member into contact with said photoconductive member at a transfer station apart from said electrifying station;

forming a second electrostatic latent image corresponding to a second color component of the image of the document on said photoconductive member;

developing the second electrostatic latent image with a second toner of the second color electrically charged with the same polarity as that of said first toner so as to form a second visible toner image on said photoconductive member;

transferring the second toner image formed on said photoconductive member onto said toner image retaining member by again bringing the electrically charged surface of said toner image retaining member into contact with said photoconductive member, so as to form a composite image comprised of the first and second toner images on said toner image retaining member, the surface of said toner image retaining member being suitably electrically charged in order to keep a predetermined electric potential at said electrifying station before transferring the first and second toner images without electrically charging said surface at said transfer station; and transferring the composite image formed on said toner image retaining member onto a paper.

6. A color image forming method using a toner image retaining member, said method comprising steps of:

forming a first electrostatic latent image corresponding to a first color component of an image of a document on a photoconductive member;

developing the first electrostatic latent image with a first toner of the first color electrically charged with a predetermined polarity so as to form a first visible toner image on said photoconductive member;

electrically charging a surface of said toner image retaining member with a polarity opposite to that of said first toner at an electrifying station;

transferring the firs toner image formed on said photoconductive member onto said toner image retaining member by bringing the electrically charged surface of said toner image retaining member into contact with said photoconductive member at a transfer station apart form said electrifying station;

forming a second electrostatic latent image corresponding to a second color component of the image of the document on said photoconductive member;

developing the second electrostatic latent image with a second toner of the second color electrically charged with the same polarity as that of said first toner so as to form a second visible toner image on said photoconductive member;

transferring the second toner image formed on said photoconductive member onto said toner image retaining member by again bringing the electrically charged surface of said toner image retaining member into contact with said photoconductive member, so as to form a composite image comprised of the first and second toner images on said toner image retaining member, the surface of the toner image retaining member being suitably electrically charged in order to keep a. predetermined electric potential at said electrifying station after erasing the charge on said toner image retaining member before transferring the second toner image without electrically charging said surface at said transfer station; and transferring the composite image formed on said toner image retaining member onto a paper.

* * * * *

UNITED STATES PATENT AND TRADEMARK OFFICE

CERTIFICATE OF CORRECTION

PATENT NO. : 4,984,026

DATED : January 8, 1991

INVENTOR(S) : Hideya Nishise and Akihiro Nishida

It is certified that error appears in the above-identified patent and that said Letters Patent is hereby corrected as shown below:

In col. 1, line 27, change "on" to --as--.

In col. 1, line 35, change "no" to --not--.

In col. 1, line 40, change "(P-A)" to --(JP-A)--.

In col. 3, line 9, change "first-color" to --first color--.

In col. 3, line 55, delete "an".

In col. 4, line 7, delete "and".

In col. 5, line 34, after "operation", insert --.-- (period).

In col. 10, line 15, change "another" to --other--.

UNITED STATES PATENT AND TRADEMARK OFFICE

CERTIFICATE OF CORRECTION

PATENT NO. : 4,984,026

DATED : January 8, 1991

INVENTOR(S) : Hideya Nishise and Akihiro Nishida

It is certified that error appears in the above-identified patent and that said Letters Patent is hereby corrected as shown below:

In col. 10, line 22, change "When" to --when--.

In col. 10, line 37, change "stitch" to --switch--.

In col. 11, line 51, delete ",," (commas).

In col. 14, line 34 (claim 5, line 4), change "the" to --a--.

In col. 15, line 21 (claim 6, line 14), change "firs" to --first--.

In col. 15, last line (claim 6, line 19), change "form" to --from--.

In the ABSTRACT paragraph, line 13 thereof, change "image" to --images--.

Signed and Sealed this

Twenty-third Day of June, 1992

*Attest:*

*Attesting Officer*

DOUGLAS B. COMER

*Acting Commissioner of Patents and Trademarks*